US005538197A

United States Patent [19]

Killian

[11] Patent Number: 5,538,197

[45] Date of Patent: Jul. 23, 1996

[54] ARCHERY BOWSTRING SERVING TOOL

[76] Inventor: Gerald I. Killian, 21635 S. Latourette Rd., Oregon City, Oreg. 97045

[21] Appl. No.: 402,765

[22] Filed: Mar. 13, 1995

Related U.S. Application Data

[63] Continuation of Ser. No. 71,823, Jun. 7, 1993, abandoned.

[51] Int. Cl.[6] ..... B65H 81/00; D02G 3/36

[52] U.S. Cl. ..... 242/439.3; 57/10

[58] Field of Search ..... 242/7.17, 7.18, 242/7.19; 57/3, 10

[56] References Cited

U.S. PATENT DOCUMENTS

| | | | |
|---|---|---|---|
| 824,171 | 6/1906 | Champlin | 57/10 |
| 2,353,727 | 7/1944 | Howard | 242/7.19 |
| 2,361,014 | 10/1944 | Crass | 57/10 |
| 3,882,662 | 5/1975 | Hazelwood | 57/10 |
| 4,013,500 | 3/1977 | Koput et al. | 242/7.19 |
| 4,346,550 | 8/1982 | Ferree | 57/10 |
| 4,790,896 | 12/1988 | Schmalholtz | 57/10 |
| 4,824,036 | 4/1989 | Buta | 242/7.19 |

OTHER PUBLICATIONS

"Making A Bow String" by C. R. Learn, Archer's Digest 1991, Chapter 4, pp 74–81, Published by DBI Books.

*Primary Examiner*—Michael R. Mansen
*Attorney, Agent, or Firm*—Olson & Olson

[57] ABSTRACT

An archery bowstring serving tool is provided in the form of an attachment to a conventional portable cordless electric power drill the motor of which provides the drive power for the tool. A drive bevel gear couples the drill motor output shaft to a driven bevel gear the body of which mounts a spool of serving line and a guide for delivering serving line through a radial slot in the gear body to an output guide which, upon rotation of the driven bevel gear, wraps serving line around bowstring extending through the radial slot at the axis of rotation of the driven bevel gear.

7 Claims, 4 Drawing Sheets

ARCHERY BOWSTRING SERVING TOOL

This application is a continuation of application Ser. No. 08/071,823, filed Jun. 7, 1993, now abandoned.

BACKGROUND OF THE INVENTION

This invention relates to archery bowstrings, and more particularly to a novel tool for applying serving line to a bowstring.

It is the recognized practice for serving line to be applied to archery bowstring by hand, with the aid of a jig by which bowstring is assembled into multiple strands and displayed in position for applying serving line to the nock and loop end areas. Such a procedure is described in "Making A Bow String" Archer's Digest, 5th Edition, 1991, DBI Books The procedure is time consuming, inefficient and inaccurate.

SUMMARY OF THE INVENTION

The archery bowstring serving tool of this invention includes a powered rotary disc provided with a radial slot for positioning bowstring at the axial center of rotation of the disc. The disc also supports a supply of serving line and a guide for directing the serving line to a position adjacent the bowstring. Accordingly, rotation of the disc around the bowstring effects wrapping the serving line around the bowstring in the areas selected.

It is the principle objective of this invention to provide an archery bowstring serving tool of the class described which overcomes the aforementioned limitations and disadvantages of the prior manual method of application.

Another objective of this invention is to provide an archery bowstring serving tool of the class described in the form of an attachment to a conventional portable electric power drill as the source of rotary power for the disc.

A further objective of this invention is the provision of an archery bowstring serving tool of the class described which is usable with a conventional bowstring assembly jig to effect the application of serving line with speed, facility and accuracy.

A still further objective of this invention is to provide an archery bowstring serving tool of the class described which is of simplified construction for economical manufacture, maintenance and repair.

The foregoing and other objects and advantages of this invention will appear from the following detailed description, taken in connection with the accompanying drawings of a preferred embodiment.

DESCRIPTION OF THE PREFERRED EMBODIMENT

Figures 1, 7:
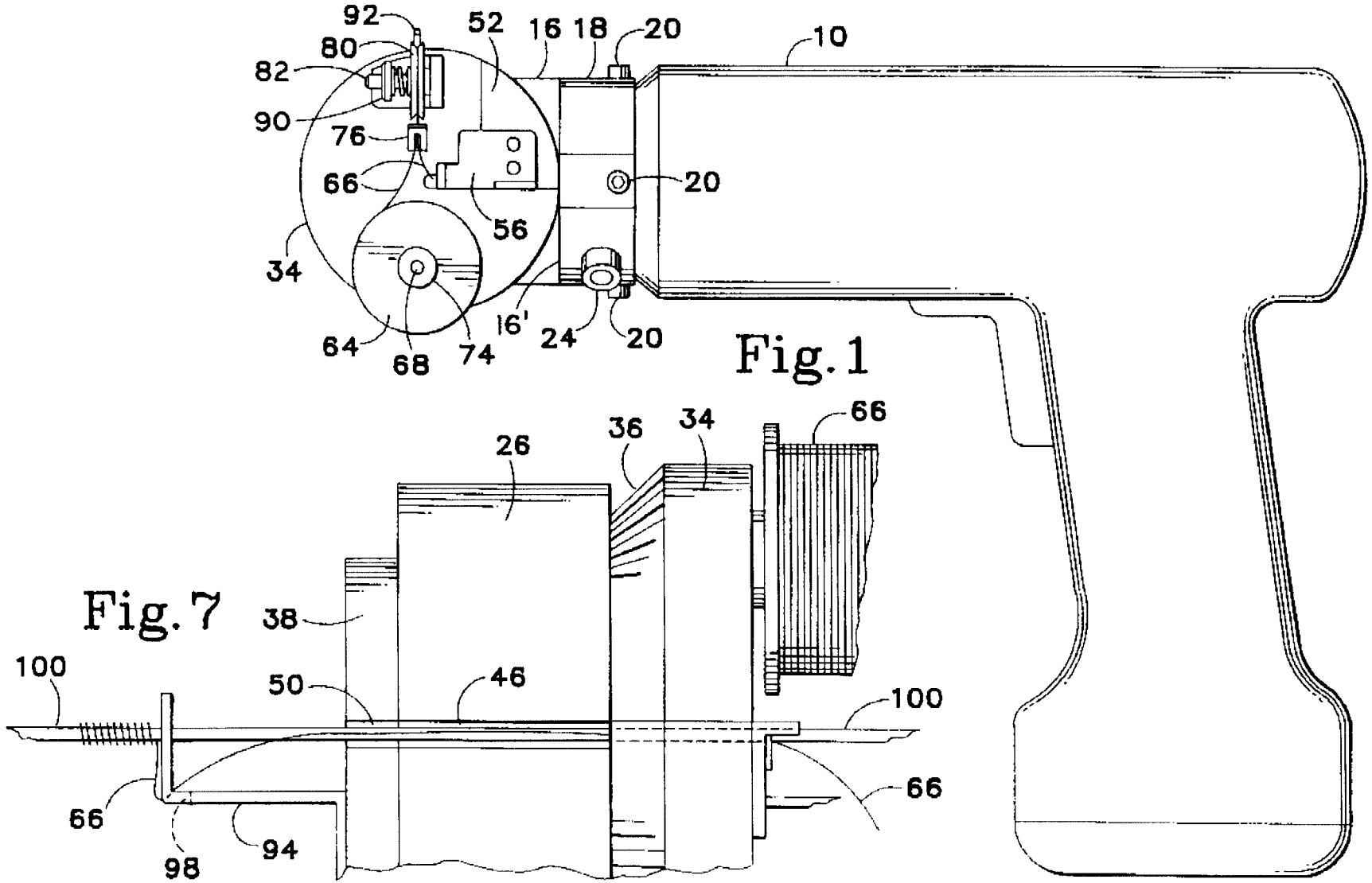
FIG. 1 is a side elevation of an archery bowstring serving tool embodying the features of this invention, the tool being shown attached to a conventional portable cordless electric power drill providing the source of rotary power for the disc.
FIG. 7 is a fragmentary front elevation, similar to FIG. 6 but on a larger scale, illustrating the wrapping of serving line about bowstring by operation of the serving tool of this invention.
Figure 2:
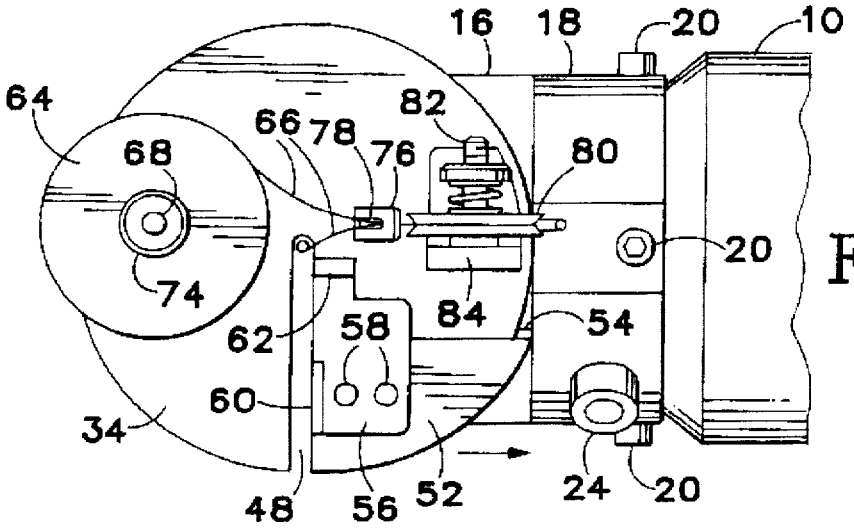
FIG. 2 is a fragmentary side elevation of the tool of FIG. 1 showing the radial slot in the disc open to receive a bowstring.
Figure 3:
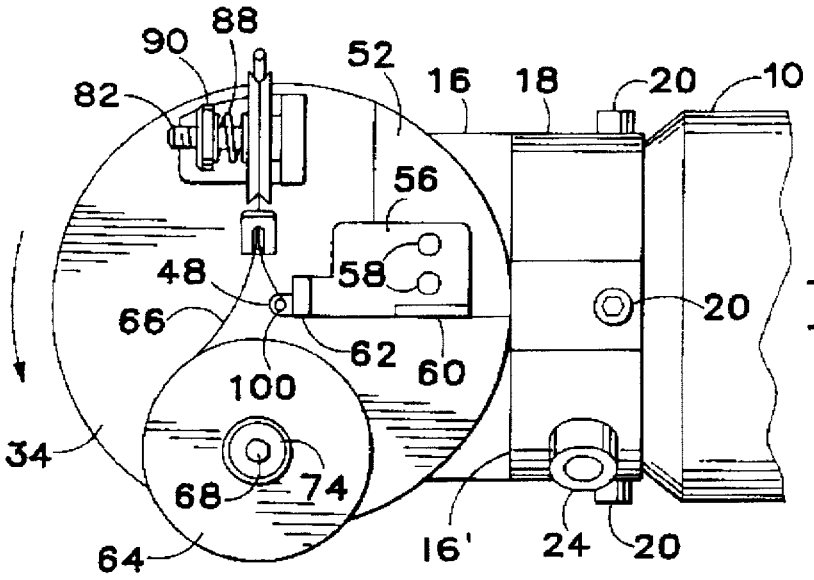
FIG. 3 is a fragmentary side elevation similar to FIG. 2 but showing the radial slot in the disc closed to capture a bowstring at the axial center of rotation of the disc.

The drawings illustrate the archery bowstring serving line tool of this invention coupled to a conventional portable cordless electric power drill 10 for use of the rotary output shaft 10' of the drill motor as the source of rotary power for the tool. For this purpose the drill chuck is removed, exposing the neck 12 for releasable attachment of a server adapter sleeve 14, as by means of a set screw.

The server adapter includes a hollow body 16 the inner end portion of which is of larger inner diameter to form a collar 18 configured to slidably fit around the sleeve 14. A plurality of retainer screws 20 in the collar are removably received in associated sleeve grooves 22 of inverted C-shape. The grooves serve to accommodate adjustment of the collar 18 between the extended position of FIG. 5 and the retracted position of FIG. 6, for purposes described hereinafter. A lock screw 24 on the collar 18 serves to secure the collar to the sleeve in either of said positions of adjustment.

An annular bearing 26 is secured to the outer end of the adapter body 16, as by means of anchor screws 28. The bearing bore 30 receives the hub 32 of a driven gear body 34 provided on the inward side with a driven bevel gear 36. The hub 32 extends freely and rotationally through the bearing bore 30 and is retained in the bearing by a gear retainer plate 38 secured by screws 40 to the end of the gear hub opposite the gear body 34. A segment of the adapter body 16 is cut away to provide room for the gear body 34. The segment terminates in an arcuate base 16' discussed hereinafter.

A drive bevel gear 42 is provided with a hub 44 having an internally threaded axial bore for threaded attachment to the projecting end of the output shaft 10' of the power drill motor.

Figure 5:
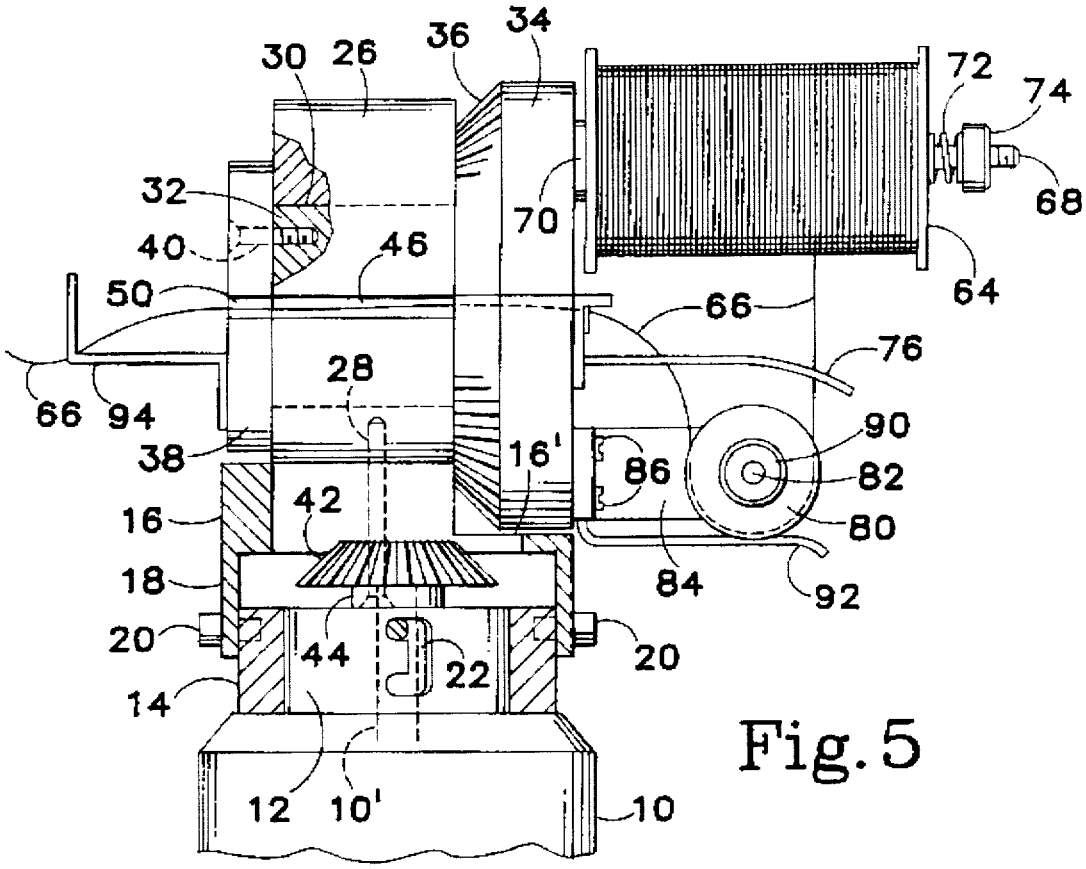
FIG. 5 is a fragmentary front elevation of the tool of FIG. 3 with the adapter body partially uncoupled from the power drill to disengage the disc gear from the drive gear of the drill.
Figure 6:
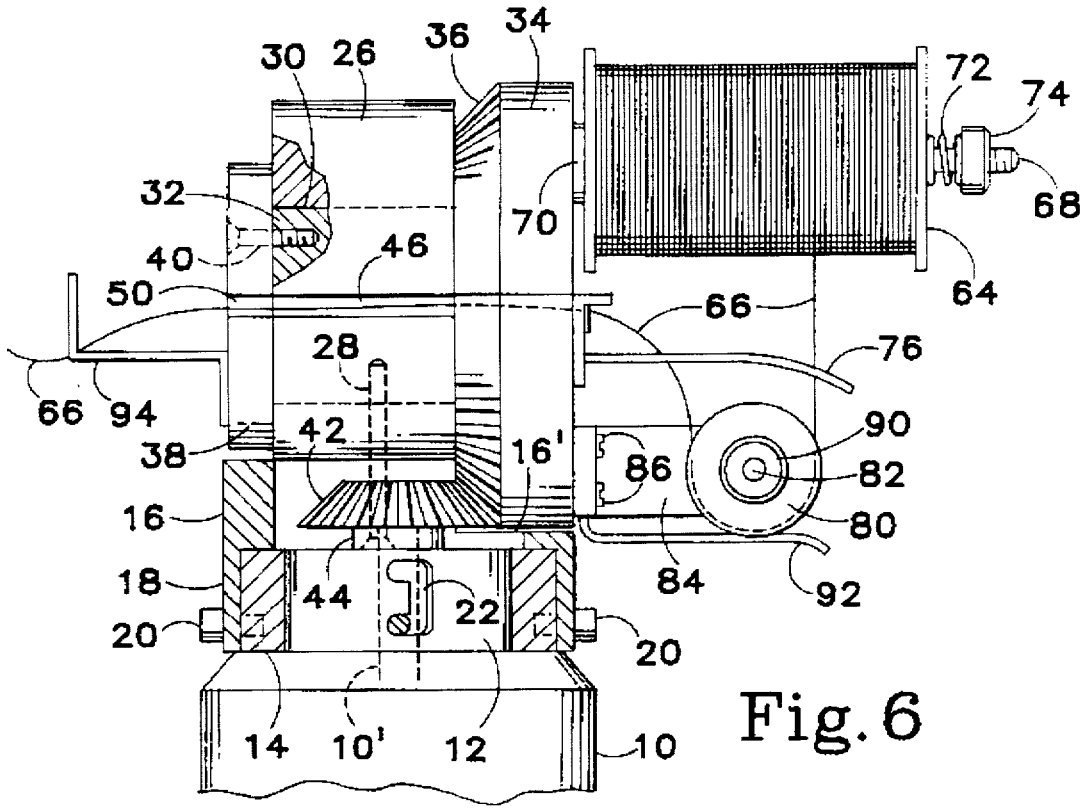
FIG. 6 is a fragmentary front elevation, similar to FIG. 5 but with the adapter body coupled to the drill and the disc gear engaged with the drive gear.

In the extended position of the adapter body 16 shown in FIG. 5, the driven bevel gear 36 is displaced outwardly from the drive bevel gear 42. In this position the retainer screws 20 are located in the outer ends of the retainer screw grooves 22. By rotating the adapter assembly slightly counterclockwise in FIG. 5 and pushing it inward toward the power drill and then rotating it slightly clockwise to move the retainer screws 20 into the lower portion of the grooves 22, the driven bevel gear 36 is brought into engagement with the drive bevel gear 42, as shown in FIG. 6. The lock screw 24 then is tightened to secure the interconnection.

A radial slot 46 is provided in the bearing 26, and a similar radial slot 48 is provided in the gear hub 32 and body 34. A registering radial slot 50 is provided in the retainer plate 38. As described more fully hereinafter, these radial slots are arranged for mutual registration for the reception therethrough of archery bowstring and serving line.

The driven bevel gear body 34 is provided with a closure segment 52 which is connected to the gear body by a dovetail or other form of coupling 54 to enable the segment to move perpendicular to the radial slot 46 to open and close the latter immediately adjacent the axial center of the bearing body 34. An operator plate 56 is secured to the segment 52 by screws 58. A finger tab 60 on the operator plate projects outwardly for grasping by the fingers to accommodate manual movement of the closure segment. On the end of the operator plate adjacent the radial center of the gear body 34 is an outwardly projecting shelf 62 which forms a support guide for bowstring and serving line contained within the radial slot.

A supply spool 64 of serving line 66 is mounted for rotation on a pivot shaft 68 secured to the driven bevel gear body 34 on the side opposite the bevel gear 36. The inner end of the spool is pressed resiliently against a hub 70 of the pivot shaft by means of a compression spring 72 bearing against the outer side of the spool. An adjustable stop 74 on the pivot shaft is adjustable along the latter to vary the compression of the spring 72, to adjust the degree of frictional resistance between the spool and pivot shaft hub.

A guide finger 76 is secured to the driven bevel gear body 34 on the same side as the supply spool 64, as by means of anchor screws. A guide slot 78 in the finger guides serving line 66 to a guide roller 80 mounted on a shaft 82 carried by a support bracket 84 secured to the gear body 34, as by anchor screws 86. A compression spring 88 on the shaft 82 bears against the outer side of the roller, and an adjustable stop 90 on the shaft serves to adjust the compression of the spring and hence the frictional resistance to rotation of the roller bearing against a hub of the shaft. A resilient finger 92 extends from the gear body 34 and bears resiliently against serving line 66 trained over the roller to prevent its displacement from the latter.

Figure 4:
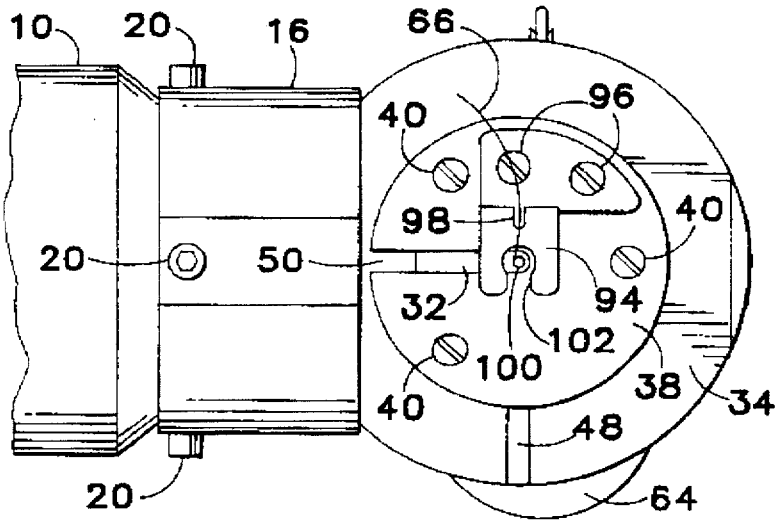
FIG. 4 is a fragmentary side elevation of the tool of FIG. 1 as viewed from the side opposite the side shown in FIG. 3.

An outfeed guide bracket 94 is secured to the retainer plate 38, as by screws 96 (FIG. 4). A guide slot 98 in the bracket serves to guide the outer end of serving line 66 to a position closely adjacent bowstring 100 extending through the axial center of the slot 50 in the retainer plate 38. A notch 102 in the outer end of the guide bracket 94 also guides the bowstring as the serving line is wrapped about it, as described hereinafter.

Figure 8:
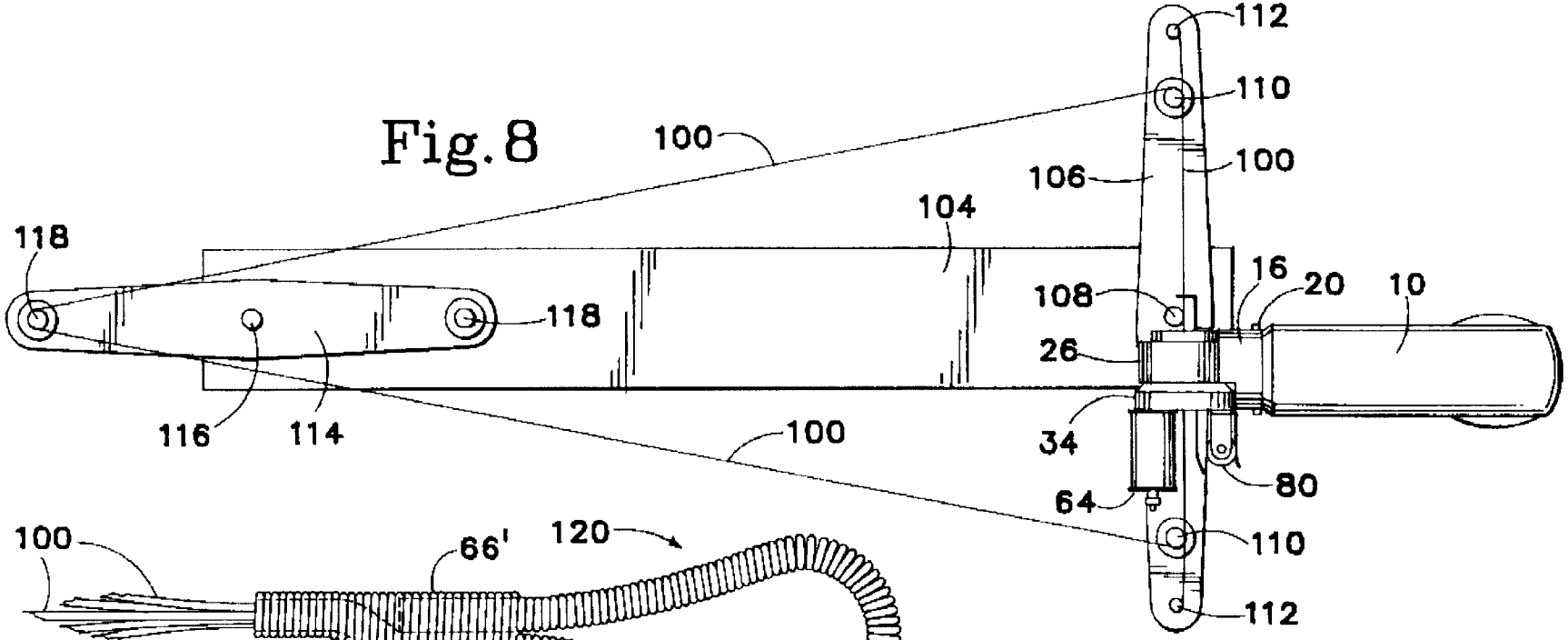
FIG. 8 is a plan view of a conventional bowstring assembly jig showing a bowstring assembled thereon and the serving tool of FIG. 1 in position applying serving line to the nock portion of the bowstring.

Referring to FIG. 8 of the drawings, there is illustrated a conventional bowstring assembly jig which facilitates the wrapping of bowstring into a multiple strand assembly properly supported for the manual wrapping of serving line in the desired areas. The jig includes an elongated base 104 which supports at one end a front end pivot arm 106 on a pivot 108. The pivot arm is provided with a pair of spaced uprights 110 and a pair of line anchors 112 outwardly of each upright. The base also supports at the opposite end a rear end pivot arm 114 mounted on pivot 116. The rear arm also supports a pair of spaced uprights 118.

FIG. 8 illustrates the application of serving line to the stretch of bowstring strands 100 extending between the uprights 110 with the arm 106 perpendicular to the base 104. As is known, bowstring line 100 is wrapped around the uprights 110 and 118 in as many strands as desired and the ends of the line anchored, as by means of the anchors 112.

The serving tool is installed on the bowstring by first loosening the lock screw 24 and disengaging the driven gear 36 from the drive gear 42 to allow rotation of the driven gear body 34. The radial slots in the bearing 26, gear body 34, hub 32 and retainer plate 38 are aligned, the driven gear body and adapter body 16 are pushed toward the power drill 10 to engage the gears 36 and 42, and the lock screw 24 tightened to secure the alignment.

The closure segment 52 is moved outward by finger pressure on the tab 60 to fully open the slot 48 in the gear body 34. The tool then is manipulated to insert the aligned slots over the stretch of bowstring strands 100 between the uprights 110, as illustrated. A length of serving line 66 then is pulled from the spool 64 and laid through the aligned slots and fed through the guide slot 98. The end of the serving line is held adjacent the bowstring and the power drill is activated.

Initial rotation of the gear body 34 brings the projecting closure segment 52 into sliding engagement with the adjacent surface of the arcuate base 16' between the adapter body 16 and collar 18, and automatically pushes the segment inward to cover the slot.

Rotation of the assembly of gear body 34, spool 64 and guides 76, 80 and 94 causes serving line 66 to wrap around the bowstring strands in a tight spiral. This is continued until the desired length of serving has been wrapped about the bowstring. The serving line is cut for anchoring, in well known manner, and the serving tool is removed from the bowstring by opening the closure segment 52 to allow retraction of the tool.

Figure 9:
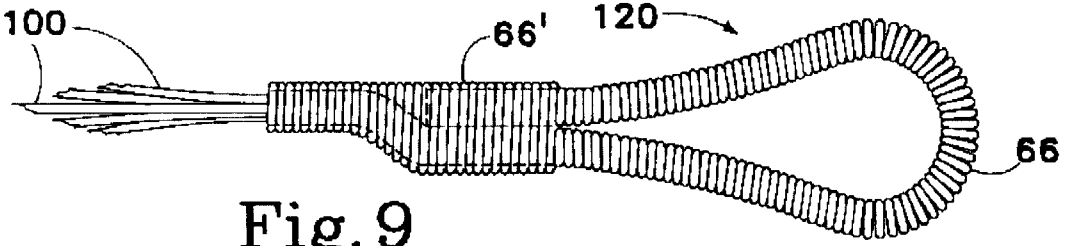
FIG. 9 is a fragmentary plan view of an archery bowstring end loop formed with serving line.

The cross arm 106 is rotated to the position parallel to the longitudinal axis of the base 104 and the bowstring readjusted to position the middle of the served section over the outermost upright 110. The adjacent lengths of the served section then are secured together by installing the serving tool over them and activating the power drill to wrap an overlying serving line 66' tightly about the two halves of served section, starting at a point which determines the size of the end loop 120 desired and wrapping toward the center of the jig. In the preferred method illustrated in FIG. 9, the ends of the served section are offset slightly, with one end extending beyond the other end. The strands of bowstring 100 extending from the shorter end of the served section are arranged about the longer end of the served section before the overlying serving line 66' is wrapped over the assembly. The serving line 66' is cut for anchoring and the tool removed, as previously described.

The foregoing procedure is repeated for the opposite end loop 120, by pivoting the cross arm 114 perpendicular to the axis of the base 104 and installing and operating the serving tool in the manner previously described.

Figure 10:
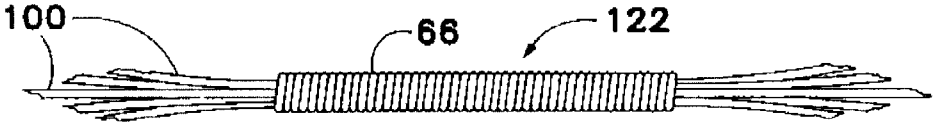
FIG. 10 is a fragmentary plan view of an archery bowstring nock portion formed with serving line.

Finally, with both cross arms 106 and 114 extending parallel to the axis of the base 104, the two lengths of bowstring strands 100 span the distance between the outermost uprights 110 and 118 and lie closely adjacent each other. A central portion of the two lengths are secured together by a length of serving wrapping to form the nock 122, by operating the serving tool in the foregoing manner. FIG. 10 illustrates the formation of this nock portion.

From the foregoing, it will be apparent that the serving tool of this invention affords the application of serving line to the desired areas of archery bowstrings with speed, facility and precision. The simplified structure of the tool affords economical manufacture, maintenance and repair.

It will be apparent to those skilled in the art that various changes may be made in the structural details described hereinbefore. For example, different forms of gear assemblies other than the bevel gears illustrated may be utilized. A power source may be integrated with the rotary components, but the attachment configuration for a conventional cordless electric power drill is preferred. The bevel gear body 34 need not be provided with the movable closure segment 52, but rather the operator plate 56 may be mounted slidably on the gear body for movement to removably cover the radial slot 48. The foregoing and other changes and modifications may be made, as desired, without departing from the spirit of this invention and the scope of the appended claims.

I claim:

1. A hand held, portable archery bowstring serving tool for making an archery bowstring including the central nock and both end loops, the serving tool comprising:

a) a portable, hand held rotary electric power motor having a rotary output shaft and a hand grip for carrying and manually manipulating the power motor, b) a body member, c) connector means interconnecting the portable, hand held power motor and body member for supporting the body member on the power motor for manual manipulation therewith and for moving the body member between first and second positions relative to the power motor output shaft, d) a rotary disc mounted on the body member for axial rotation, the disc having a radial slot configured to position bowstring therein on the axis of rotation of the disc, e) means on the disc for supporting a supply of serving line, f) guide means on the disc for delivering serving line adjacent the axis of rotation of the disc, whereby rotation of the disc effects wrapping of serving line around a bowstring positioned in the radial slot on the axis of rotation of the disc, and g) coupler means on the rotary output shaft and the disc, respectively, for coupling the portable, hand held rotary power motor to the disc for rotating the disc when the body member is moved to said first position relative to the power motor output shaft and for uncoupling the power motor from the disc when the body member is moved to said second position relative to the power motor output shaft.

2. The archery bowstring serving tool of claim 1 wherein the rotary motor means comprises an electric rotary motor of a portable electric drill.

3. The archery bowstring serving tool of claim 1 wherein the coupler means includes a drive gear connected to the rotary output shaft of the rotary motor, and a driven gear on the disc releasably engageable with the drive gear.

4. The archery bowstring serving tool of claim 1 including:

a) closure means on the disc for removably closing the radial slot adjacent the axis of rotation of the disc for removably retaining a bowstring in said slot at said axis of rotation, b) the closure means including a segment of the disc mounted on the disc for adjustable movement perpendicular to the radial slot for opening and closing said slot, c) the disc being mounted for rotation closely adjacent the body member, whereby the closure segment is moved from slot-opening position to slot-closing position upon rotation of the disc.

5. The archery bowstring serving tool of claim 1 including closure means on the disc for removably closing the radial slot adjacent the axis of rotation of the disc for removably retaining bowstring in said slot at said axis of rotation.

6. The archery bowstring serving tool of claim 5 wherein the closure means includes a segment of the disc mounted on the disc for adjustable movement perpendicular to the radial slot for opening and closing said slot.

7. The archery bowstring serving tool of claim 1 wherein the means on the disc for supporting a supply of serving line comprises a shaft for supporting a spool of serving line for rotation thereon.

* * * * *